US005228613A

United States Patent [19]

Compagnucci

[11] Patent Number: 5,228,613

[45] Date of Patent: Jul. 20, 1993

[54] MACHINE FOR THE AUTOMATIC AND CONTINUOUS PRODUCTION OF WIRE WINDING SPOOLS

[75] Inventor: Rossano Compagnucci, Osimo, Italy

[73] Assignee: Compagnucci - S.p.A., Santa Maria Nuovo, Italy

[21] Appl. No.: 949,800

[22] Filed: Sep. 22, 1992

[30] Foreign Application Priority Data

Oct. 1, 1991 [IT] Italy ..... AN91A000035

[51] Int. Cl.[5] ..... B23K 9/00

[52] U.S. Cl. ..... 228/5.1; 228/15.1; 228/173.5; 29/897

[58] Field of Search ..... 228/4.1, 5.1, 15.1, 228/18, 44.3, 173.5; 29/897, 897.31, 897.312, 897.34; 219/137.2

[56] References Cited

U.S. PATENT DOCUMENTS 3,748,720 7/1973 Versteeg ..... 228/173.5

4,372,350 2/1983 Schmidt et al. ..... 228/173.5

*Primary Examiner*—Samuel M. Heinrich

*Attorney, Agent, or Firm*—Leonard Bloom

[57] ABSTRACT

This invention concerns a machine for the automatic and continuous production of wire winding spools, and in particular metal welding wire for welding machines. The machine in question consists of three successive operating stations through which two parallel, straight metal rods are carried at intermittent speed; in the first station, upside down "U" shaped brackets are welded on the above rods; in the second station the rods are bent, repeatedly to shape a closed polygon; in the third station the interfacing ends of each open ring of the spool are welded.

2 Claims, 7 Drawing Sheets

MACHINE FOR THE AUTOMATIC AND CONTINUOUS PRODUCTION OF WIRE WINDING SPOOLS

This design patent application concerns a machine for the automatic and continuous production of wire winding spools, in particular welding wire for welding machines.

The frame of these metal spools consists of a core and two side annular flanges which hold the wire wound around the core.

The latter is generally a cylindrical cage having a horizontal axis whose bars coincide with the middle transverse section of a series of radial "U" shaped brackets whose vertical, opposing and parallel arms are welded to two rings which form, together with said arms, the two side flanges of the spool.

The machine according to the invention is an absolute novelty with respect to past techniques in that currently the production procedure used for manufacturing spools involves the preparation of "U" shaped brackets from a metal rod which is repeatedly cut to size and bent by a press, as well as the preparation of rings, again from metal rod, which is repeatedly cut to size and welded, after being bent into a ring by means of shaping tools. Assembly of the "U" shaped brackets to the pair of rings currently requires the use of special welding machines which can support and weld all the transverse brackets to the two side rings at the same time.

The automatic machine according to the invention can, on the other hand, continuously produce metal spools from two straight metal rods which are fed horizontally and parallel to each other, in intermittent steps, through three successive operating stations.

The first station consists of:

tools which grasp and pull the pair of rods;

tools for lifting one bracket at time from a storing rail where numerous "U" shaped rods are lined-up, upside down, ready to be lifted;

tools for welding, on the adjacent rods, the vertical arms of a metal "U" shaped bracket positioned upside down and transversely to the intermittent movement of the rods;

The second station consists of:

tools for simultaneously bending the adjacent rods twice;

tools for simultaneously cutting the two rods when they have been shaped into a closed polygon, after repeated bending.

The third station consists of:

tools for lifting and carrying the open spool produced in the second station into a welding mask;

tools for welding the two interfacing ends of each ring of the open spool, in rapid sequence.

As previously mentioned, the pair of adjacent rods are carried in intermittent steps through the above three stations: in particular each step is equal to the distance between one bracket and another, measured along the perimeter of the polygonal rings of the spool.

In this particular case involving spools with eight transverse brackets, the pair of parallel straight metal rods, is moved forward by a step exactly equal to one eighth of the perimeter of the regular polygon that the two rods form after having being bent repeatedly in the second station.

The number of sides of each polygonal ring is double the number of brackets of the spool since in standard spools the brackets are welded, as an alternative, at the centre of the sides of the two polygonal rings.

It is only for this reason that in the second station the section of rod between the two brackets is bent twice, instead of only once at the middle.

For major clarity the description continues with reference to the drawings which are enclosed for illustrative purposes and not in a limiting sense, whereby:

FIG. 3A illustrates blow-ups of several single construction components of the second operating station, also shown in FIG. 3;

FIG. 3B is a blow-up of FIG. 3;

With reference to drawings 1, 2, 4, 6 and 7, the first station (A) consists of tools for grasping and pulling the two rods (T), which are adjacent and parallel on the same horizontal plane, in intermittent steps.

These tools consist of a clip for each rod, consisting of two superimposed rollers (1) which are held by means of a pneumatic actuator (1*a*), against each other, so as to clasp the rod "T" lying between the same.

The two clips are installed on the two sides of a supporting plate (2*a*), which is part of a trolley which performs alternating horizontal runs by means of a pneumatic cylinder (3), whose shaft is fixed on the back of the supporting plate (2*a*).

Figure 1:
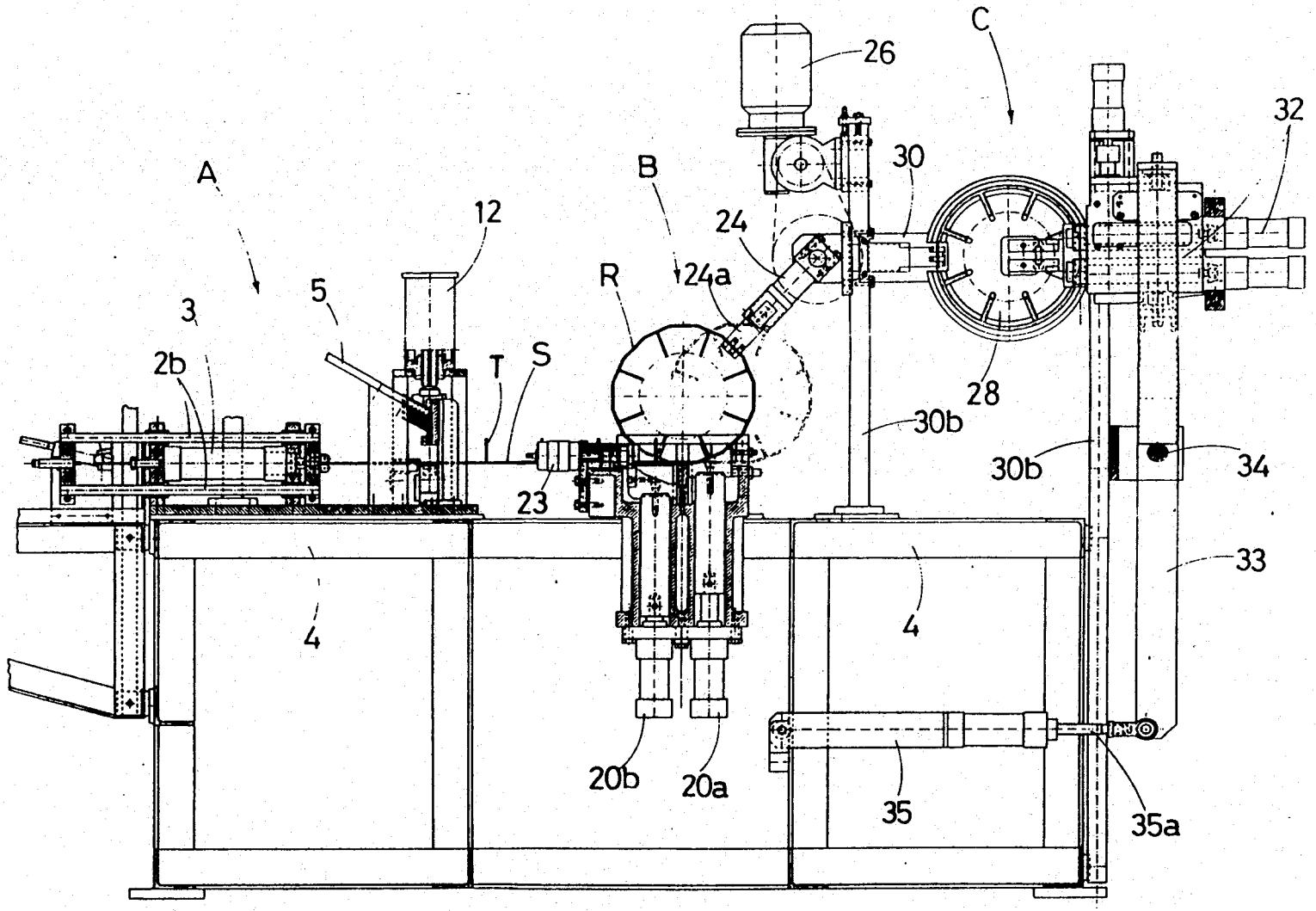
FIG. 1 is a side view of the machine according to the invention, some components of which have been illustrated as cross-sections with a longitudinal vertical plane.
Figure 2:
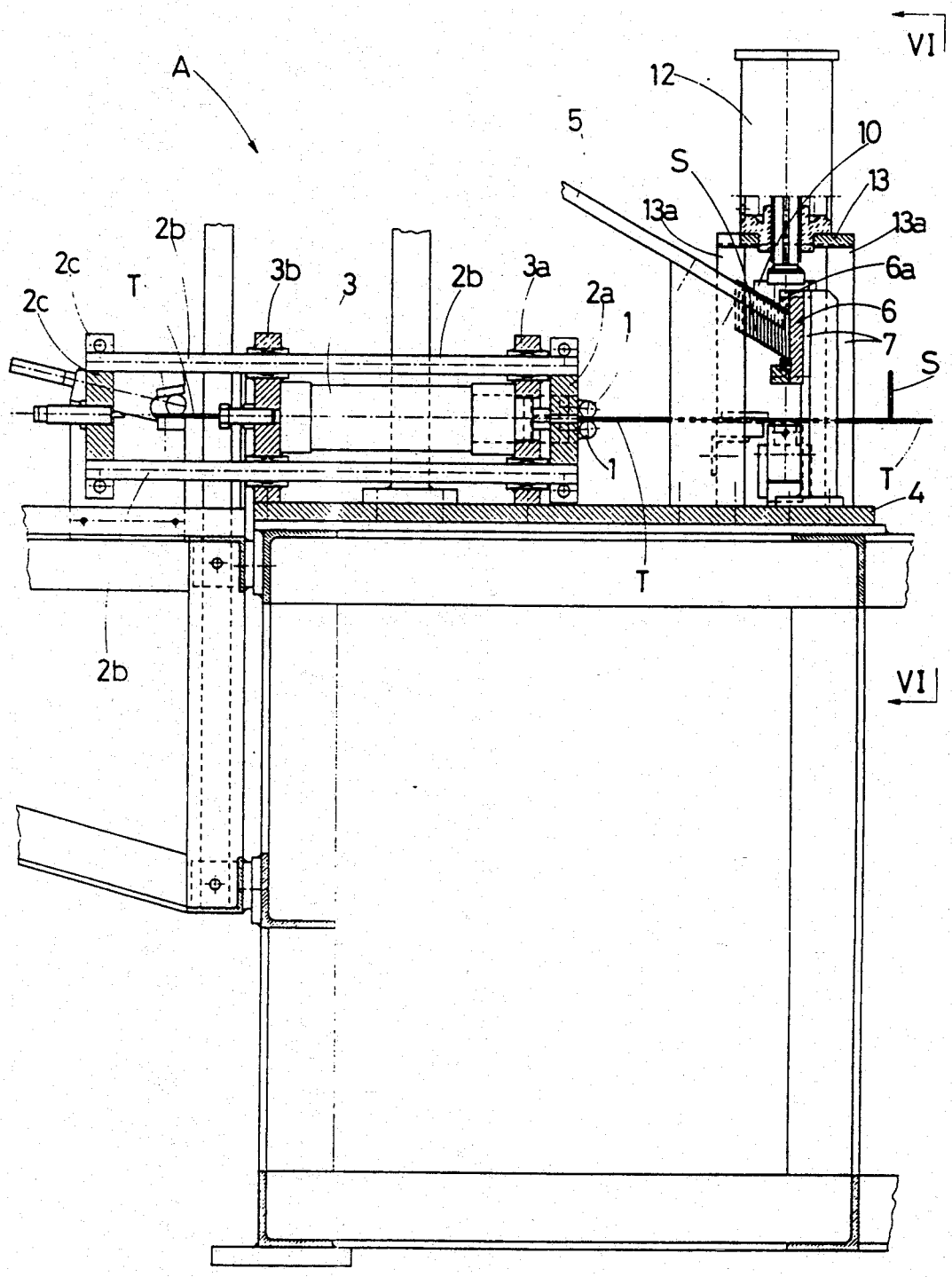
FIG. 2 is a blow-up of FIG. 1 illustrating the first operating station.
Figure 4:
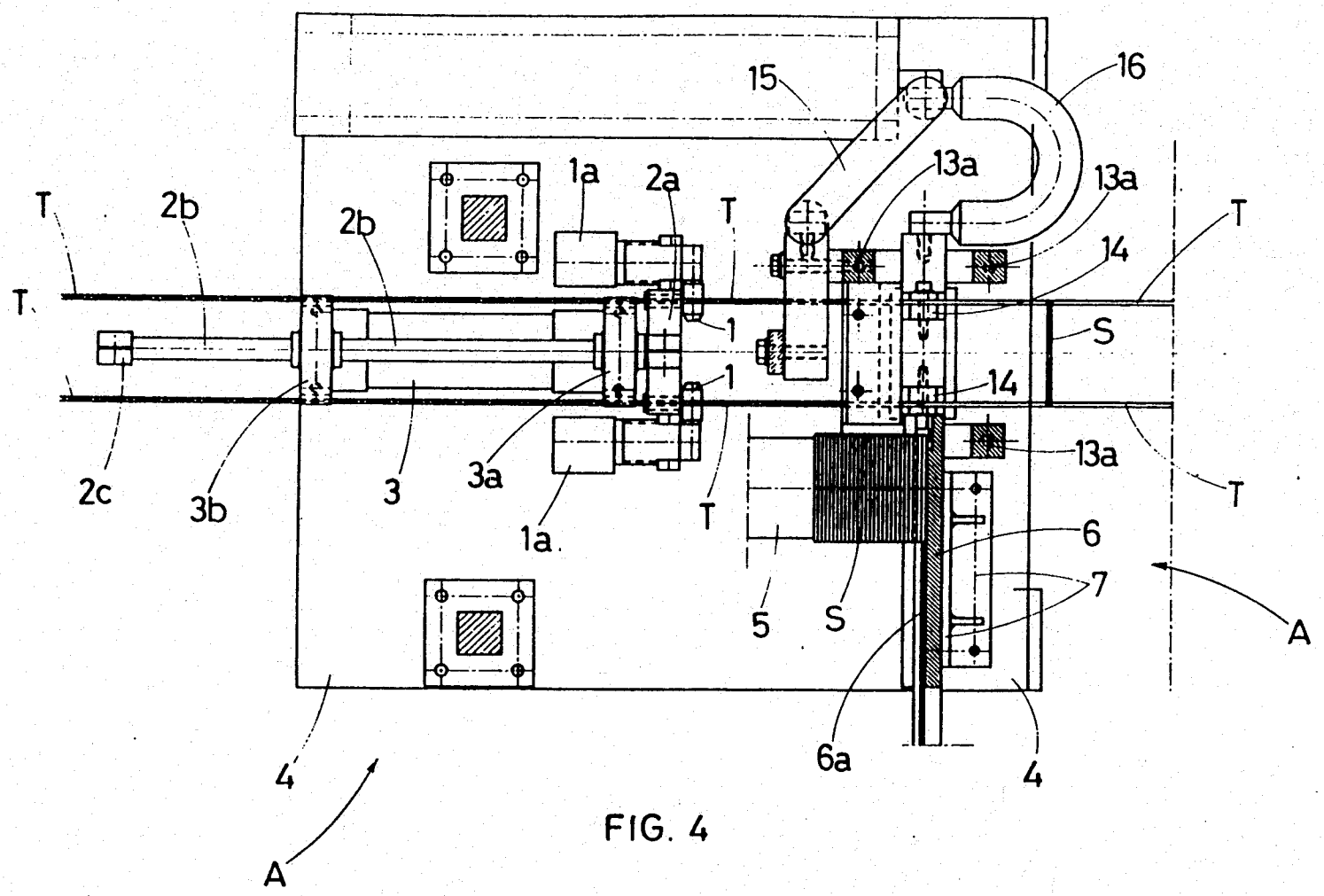
FIG. 4 is a view of the first station shown in FIG. 2.

With particular reference to FIGS. 2 and 4, it can be noted that cylinder (3) is installed inside two upright columns (3*a* and 3*b*) which are fixed to base (4) of the machine. Upright columns (3*a* and 3*b*) feature through holes into which the two horizontal bars (2*b*), which connect the front plate (2*a*) and the back plate (2*c*) of the trolley, are housed and slide.

Before said holding and pulling tools, the first station (A) consists of tools for lifting the metal brackets (S) placed over one grouping slide (5), one at a time. The first station (A) also has tools for positioning and welding bracket (S), which is lifted from the slide (5), on the rods (T).

The first bracket (S), of the row of brackets moving along the slide (5), is pushed by the back row, so that it abuts against a transfer track (6*a*), on a vertical and orthogonal plane in the direction in which the pairs of rods (T) are moving.

Said track (6*a*) is cut into the rear face of a plate (6) screwed on the wall of a vertical plate (7) projecting from the base (4) of the machine.

The track (6*a*) has a cutter (8) which is driven in alternating horizontal runs by a pneumatic cylinder (9)

which is supported by a frame (10) fixed on the top edge and on the bottom edge of the above plate (6).

In front of the exit section of the track (6a) there is a clamp (10) consisting of a fixed vertical plate (10a) and a mobile counter-plate (10b), driven by a pneumatic cylinder (11) between which the cutter (8) drives the bracket (S) lifted from track (5).

Clamp (10) is fixed to the base of the shaft (12a) of a pneumatic cylinder (12), having a vertical axis, installed above a platform (13) supported by legs (13a) fixed to the base (4) of the machine.

When a bracket (S) enters the clamp (10), the mobile plate (10b) fixes it against the fixed plate (10a) and the clamp (10) is then lowered by the cylinder (12) so as to take the "legs" of the bracket (S) into direct contact with the two underlying rods (T), resting above two grooved blocks (14). The bracket (S) is fixed to the rods (T) by means of an electrical welding machine, so that for a moment current is passed to the clamp (10) and to the blocks (14) by means of the respective electric wires (15 and 16).

Figure 3:
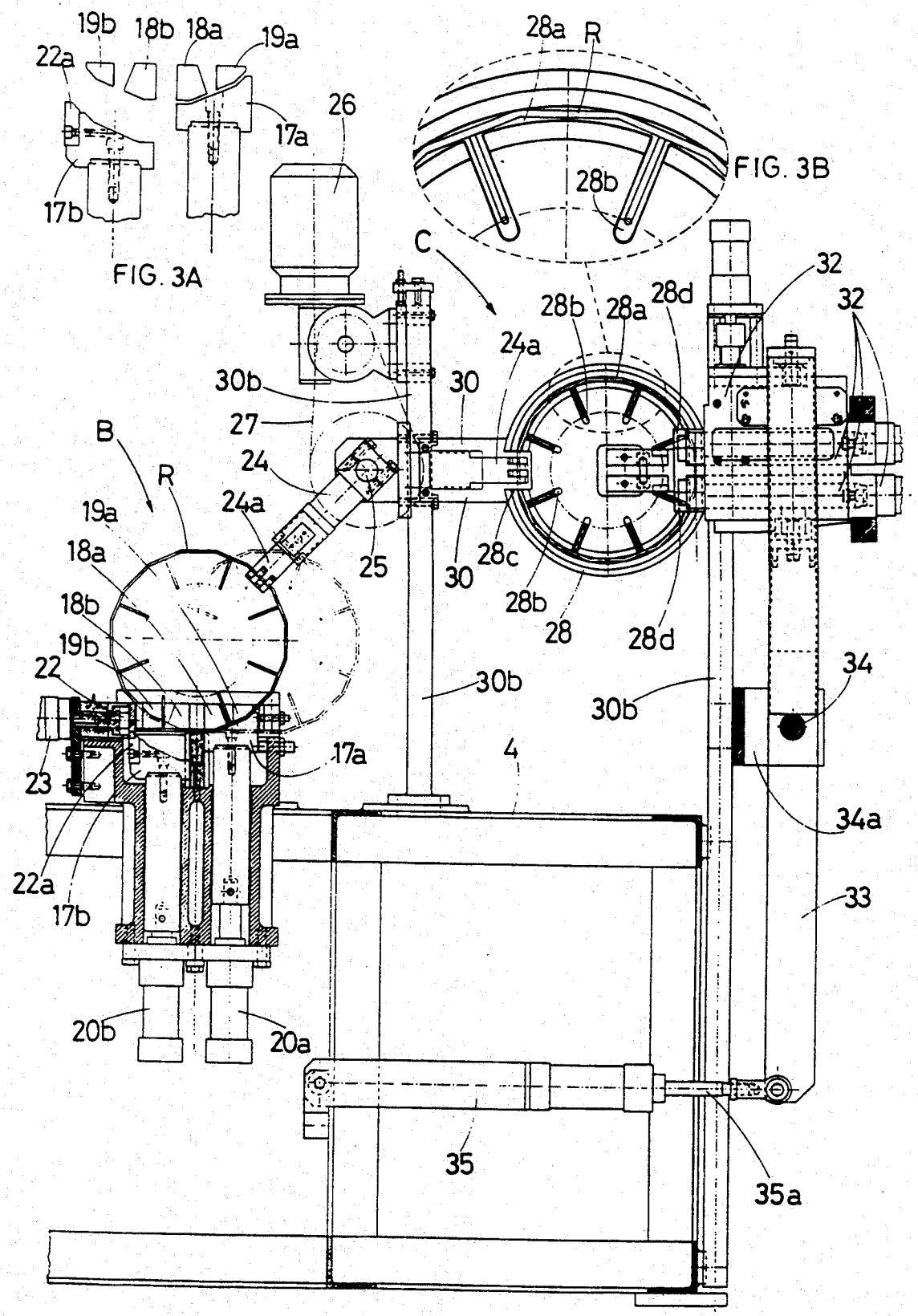
FIG. 3 is a blow-up of FIG. 1 illustrating the second and the third operating station.
Figure 5:
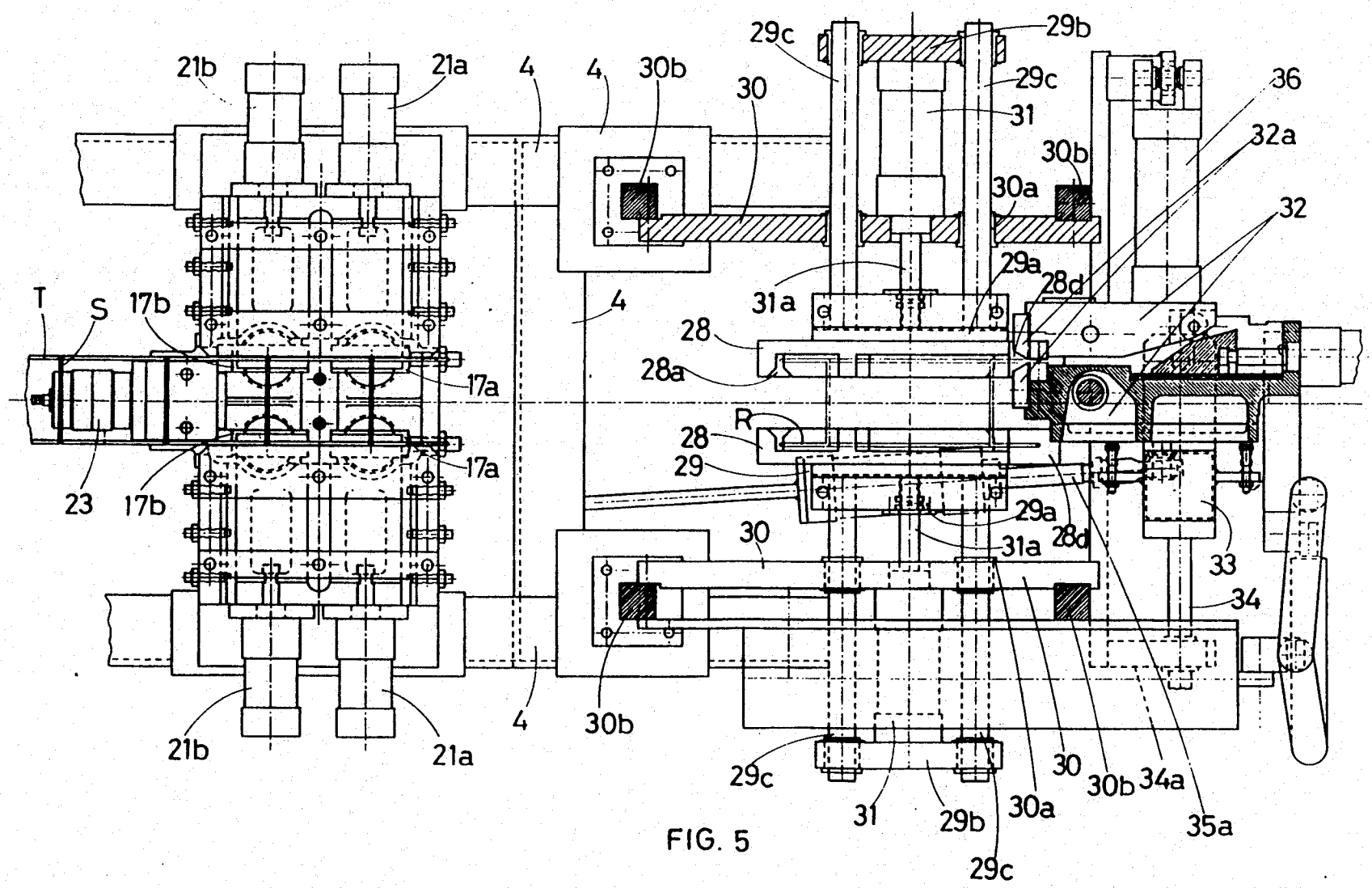
FIG. 5 is a view of the second and third station shown in FIG. 3.
Figures 6, 6A:
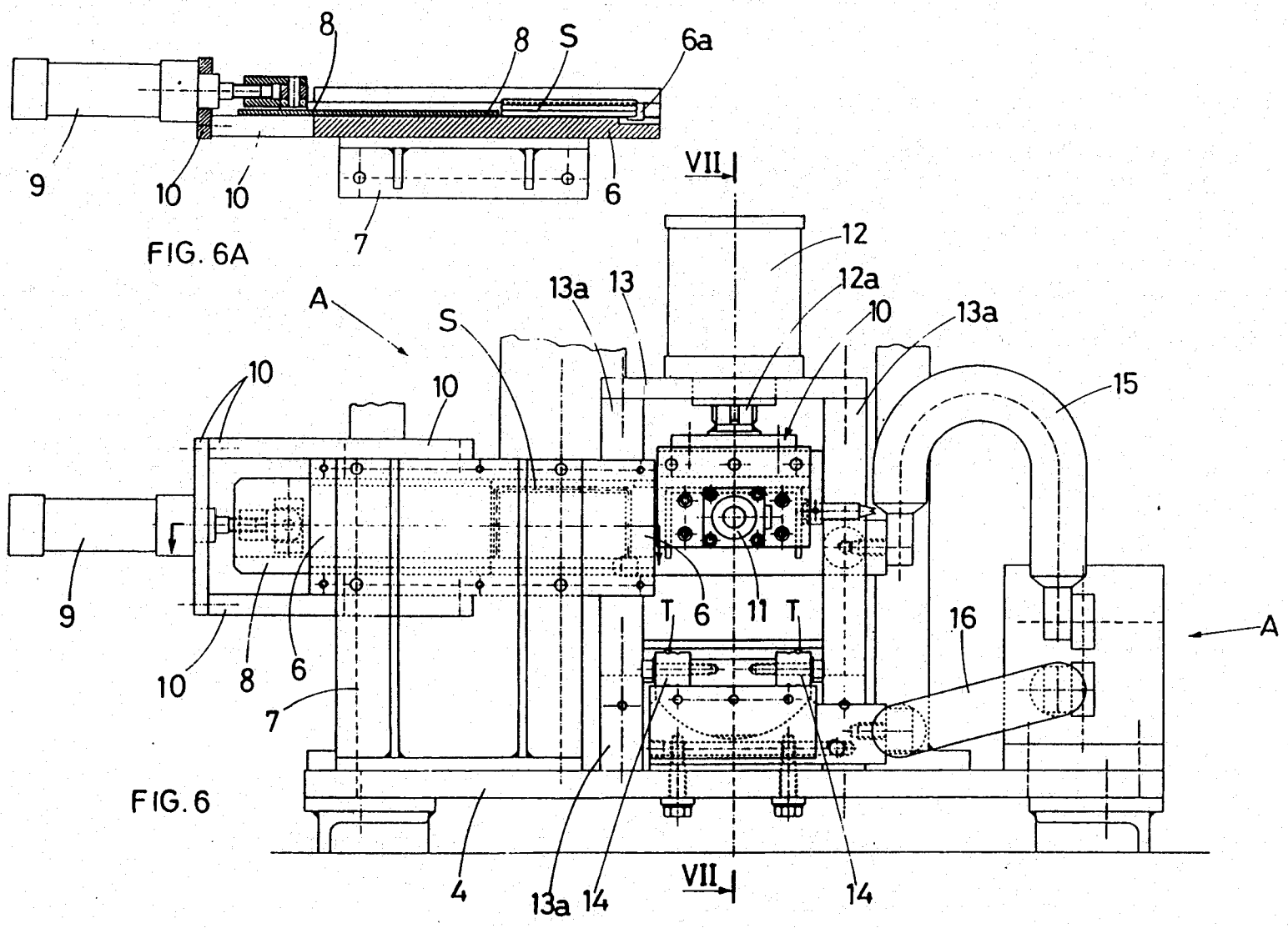
FIG. 6 is a view of FIG. 2 in direction VI—Vi indicated in FIG. 2.
FIG. 6A is the cross-section on a horizontal plane of a construction component of the first station, illustrated in the view in FIG. 6.
Figure 7:
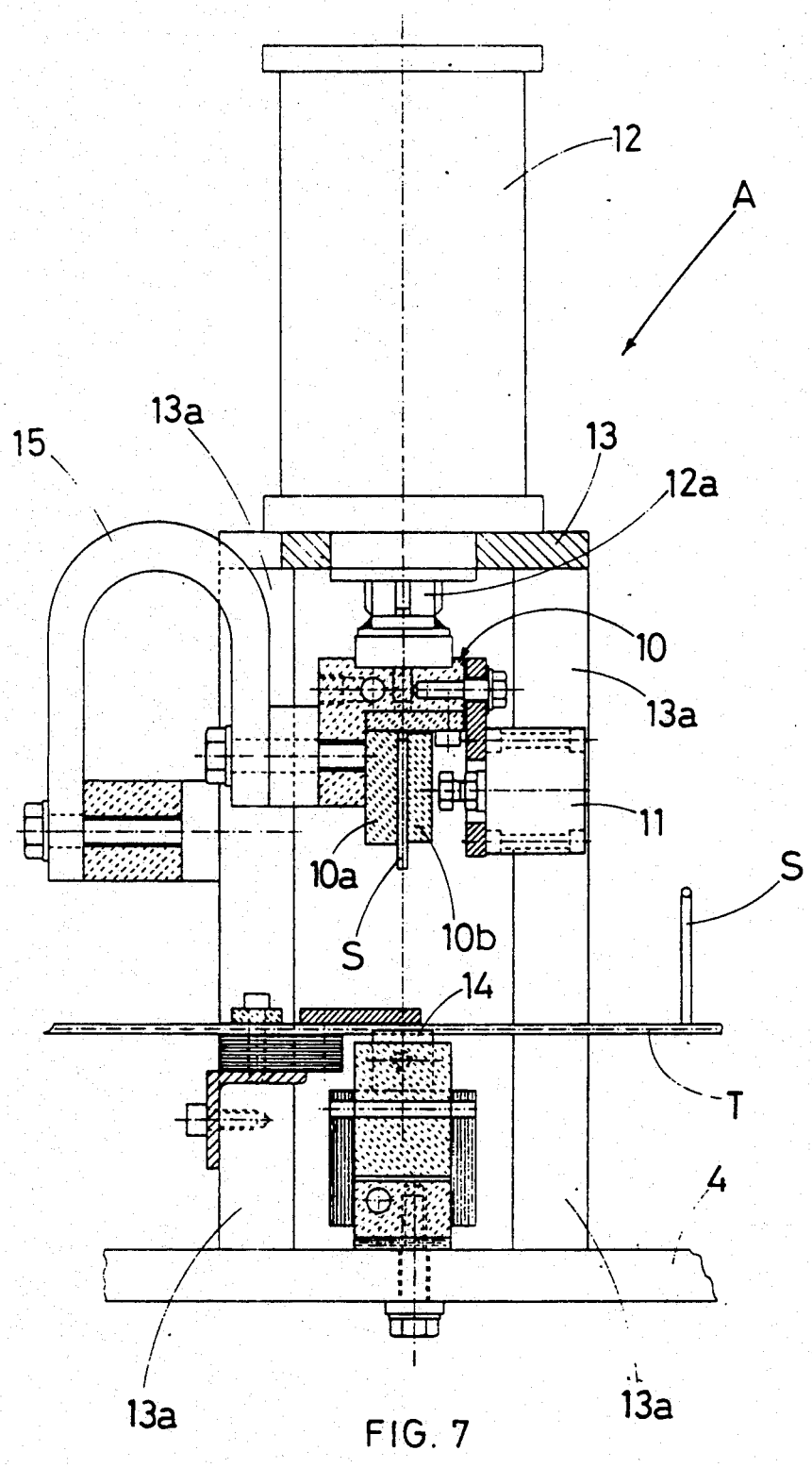
FIG. 7 is the cross-section of FIG. 6 with plane VII—VII shown in FIG. 6.

With reference to FIGS. 3 and 5, the second station (B) consists of tools for simultaneously bending the two "T" rods; with particular reference to FIG. 3A, it can be noted that each rod (T) is bent by a vertically translating punch (17a) which cooperates with two overlying fixed supporting bases (18a and 19a) against which the rod (T) is pushed from bottom to top, by the punch (17a) by means of a hydraulic cylinder (20a) having a vertical axis.

The punch (17a) obviously intervenes rhythmically in synchronism with the intermittent forward movement of the pair of rods (T).

The supporting bases are supported by respective horizontal sliding blocks which slide transversely with respect to the forward movement of the two rods (T).

The final bending operation of the rods (after which the polygonal rings are closed) is not carried out by the punch (17a), but by a punch (17b) adjacent and in front of punch (17a), having an identical and symmetrical profile to that of punch (17a).

Punch (17b), driven by its own pneumatic cylinder (20b) cooperates with two fixed overlying supporting bases (18b and 19b) having an identical and symmetrical profile to that of the supporting bases (18a and 18b).

For the final bending operation, the supporting bases (18a and 19a) are pushed back by a hydraulic cylinder having a horizontal axis (21a), while the supporting bases (18b and (19b)—which had previously been idle and pushed back—are now moved forward by means of a hydraulic cylinder having a horizontal axis (21b).

When the punch (17b) rises, the rods (T) are cut by a knife (22a) fixed on the punch (17b) which cooperates with a counterblade (22), which is activated at the right moment by a pneumatic actuator (23).

Once the rods (T) have been cut and the last bending operation has been completed, the spool (R) is carried from the second station (B) to the third station (C) by means of a pair of adjacent oscillating arms (24) terminating with a clip (24a) whose jaws are opened and closed pneumatically. With particular reference to FIG. 3 it can be noted that the arms (24) are mounted on a horizontal shaft (25) which are rotated in alternation by a geared motor (26) by the intervention of a driving belt (27).

The oscillating arms (24) carry the spool (R), from station (B), into two circular opposing plates (28), supported externally by plates (29a) being part of a trolley, consisting of two plates (29a and 29b) connected by two circular bars (29c) which are housed and slide in guide bushings (30a) on the support (30) of a bearing portal frame whose uprights (30b) are fixed and rest on the base (4) of the machine.

Plate (29a) is fixed to the shaft (31a) of a pneumatic cylinder (31) having a horizontal axis, installed on the external wall of said support (30), whereby the plates (28) can, at the appropriate time, be drawn closer to stop the spool (R) fitted between the same and supported by the oscillating arms (24).

The internal surfaces of the plates (28) have an annular groove (28a) and a series of radial grooves (28b) where the peripheral rings of the spool (R) and the side "legs" of the bracket (S), can be housed respectively.

Said plates also have two diametrically opposing slots, one (28c) for housing the clips (24a) of the oscillating arms (24) and the other (28b) for housing the tips (32a) of the welding pincers (32).

The head welding pincers (32) are installed in staggered position, on an upright (33) having at the middle of its side two coaxial and opposing horizontal pins (34) which rotate and slide within respective support housings (34a). The oscillation of the column (33) is by means of a pneumatic cylinder (35), whose shaft (35a) is hooked to the base of the column (33) while the translation of the column (33) is obtained by means of a hydraulic cylinder (36).

The oscillation of the column (33) makes it possible to insert the tips (32a) of the welding pincers (32) into the slots (28d) of the plates (28) when the peripheral rings of the spool (R) are welded; once the first of the two rings has been welded, the welding pincers (32) are first pushed backwards, thanks to the oscillation of the column (33) and then carried in front of the next ring which is to be welded, thanks to the translation of the column (33) by means of the cylinder (36).

At this point, a further oscillation of the column (33) allows the welding pincer (32) to work on the second ring of the spool.

Once the second ring has been welded, the pincer (32) is once again pushed back, while the plates (28) are drawn away so that the finished spool (R) falls into the collection and unloading tray.

What is claimed is:

1. A machine for the automatic and continuous production of wire winding spools consisting of three operating stations, characterized in that the first station (A) consists of:

tools for grasping and pulling, in intermittent steps, the pair of adjacent rods (T), consisting of a pair of clips made of two superimposed rollers (1) which are held by means of a pneumatic actuator (1a) and installed to the two sides of a supporting plate (2a) being part of a trolley which is pulled in alternating horizontal runs by a pneumatic cylinder (3) whose shaft is fixed to the back of the plate (2a); said cylinder (3) is installed inside the two upright columns (3a and 3b) fixed to the base (4) of the machine having through holes housing the two horizontal bars (2b) which connect the front plate (2a) and the back plate (2c) of the above trolley;

tools for lifting the metal brackets (S) placed over a slide (5), one at a time, said slide consisting of a cutter with horizontal movement (8) driven by a pneumatic cylinder (9) and sliding in a track (6a) cut on the internal face of a plate (6) screwed to the wall of a vertical plate (7) projecting from the base (4) of the machine;

tools for positioning and welding the bracket (S), lifted from the slide (5), on the rods (T), consisting of a clamp (10), placed in front of the exit of the track (6*a*) and consisting of a fixed vertical plate (10*a*) and a mobile counter-plate (10*b*), driven by a pneumatic cylinder (11); said clamp (10) is fixed to the base of the shaft (12*a*) of a pneumatic cylinder (12), having a vertical axis, installed above a platform (13) supported by legs (13*a*) fixed to the base (4) of the machine; cables (15 and 16) for the supplying power to supply to the clamp (10) and the blocks (14), are also provided;

the second station (B) consists of:

tools for simultaneously bending the two rods (T), consisting of a vertically translating punch (17*a*) driven by a pneumatic cylinder (20*a*) and cooperating with two superimposed dashboards (18*a* and 19*a*) supported by a horizontal slide driven by a pneumatic cylinder (21*a*); the final bending operation of the rods is carried out by a different punch (17*b*), placed adjacent to and in front of punch (17*a*) and having an identical and symmetrical profile to that of punch (17*a*); said punch (17*b*) is driven by its own pneumatic cylinder (20*b*) having a vertical axis and cooperating with two respective and overlying dashboards (18*b* and 19*b*) having an identical and symmetrical profile with respect to the dashboards (18*a* and 19*a*) and supported by a horizontal slide driven by a pneumatic cylinder (21*b*);

tools for cutting the rods (T) consisting of a knife (22*a*) fixed on the punch (17*b*) and cooperating with a counter-blade (22) driven by a pneumatic actuator (23);

the third station (C) consists of:

tools for lifting the spool (R) from the second station and transferring the same to the third station which consists of a pair of adjacent oscillating arms (24) terminating with a clip (24*a*) whose jaws are opened and closed pneumatically and installed on a horizontal shaft (25) rotated in alternation by a geared motor (26) thanks to the intervention of a drive belt (27);

tools for stopping the spool (R) during welding, consisting of two opposing circular plates (28), supported externally by plates (29*a*) being part of a trolley which in turn consists of two plates (29*a* and 29*b*) connected by two circular bars (29*c*) housed and sliding in a guide bushing (30*a*) on the support (30) of a bearing portal frame whose uprights (30*b*) rest and are fixed to the base (4) of the machine; plate (29*a*) is fixed to the shaft (31*a*)) of a pneumatic cylinder (31) having a horizontal axis, installed on the external door of said support (30); said plates (28) have an annular groove (28*a*) on their internal face and a series of radial grooves (28*b*), while on their external edge they have two diametrically opposing slots, one (28*c*) for housing the clips (24*a*) of the oscillating arms (24) and the other (28*d*)) for housing the tips (32*a*)) of the welding pincers (32);

tools for welding the spool (R) held by the plates (28), consisting of head welding pincers (32) installed in a staggered position on an upright column (33) having two coaxial and opposing horizontal pins (34) at the middle, which rotate and slide in their respective housings (34*a*); two cylindrical pneumatic cylinders (35) and (36) are provided for oscillating and translating the column (33).

2. A machine for the automatic and continuous production of wire winding spools according to the previous claim characterized in that the adjacent pair of rods is carried in intermittent steps through the three operating stations, at a speed proportional to the distance between brackets, measured along the perimeter of the polygonal rings of the spool.

* * * * *